US006212960B1

(12) United States Patent
Durand-Texte et al.

(10) Patent No.: US 6,212,960 B1
(45) Date of Patent: Apr. 10, 2001

(54) APPARATUS FOR MEASURING THE FLATNESS OF A STRIP IN MOVEMENT

(76) Inventors: Gérard Durand-Texte, 14 Rue Odeon, 75006 Paris; Pierre Le Conte, 4 Square Latour Mavbourg, 75007 Paris; Eric Bourgain, 21, rue aux Flageards, 60300 Senlis, all of (FR)

( * ) Notice: Subject to any disclaimer, the term of this patent is extended or adjusted under 35 U.S.C. 154(b) by 0 days.

(21) Appl. No.: 09/201,598

(22) Filed: Nov. 30, 1998

(30) Foreign Application Priority Data

Dec. 1, 1997 (FR) ..... 97 15 074

(51) Int. Cl.[7] ..... G01L 5/10
(52) U.S. Cl. ..... 73/862.07
(58) Field of Search ..... 73/862.391, 862.07, 73/862.05, 862.03, 862.01

(56) References Cited

U.S. PATENT DOCUMENTS 4,116,029 * 9/1978 Fabian et al. ..... 72/31.01
4,332,154 6/1982 Nordvall ..... 72/31
4,976,158 12/1990 Ginzburg et al. ..... 73/862.07
5,305,649 * 4/1994 Larimore ..... 73/862.391
5,537,878 * 7/1996 Sendzimir et al. ..... 73/862.391
5,629,487 * 5/1997 Mucke et al. ..... 73/818

FOREIGN PATENT DOCUMENTS 0 710 816 5/1996 (EP) .
0 775 890 5/1997 (EP) .

* cited by examiner

*Primary Examiner*—Max Noori
(74) *Attorney, Agent, or Firm*—Seidel, Gonda, Lavorgna & Monaco, PC

(57) ABSTRACT

The apparatus has a measuring roller (10, 10*i*) which comprises independent peripheral regions deformable by compression.

Figure 1:
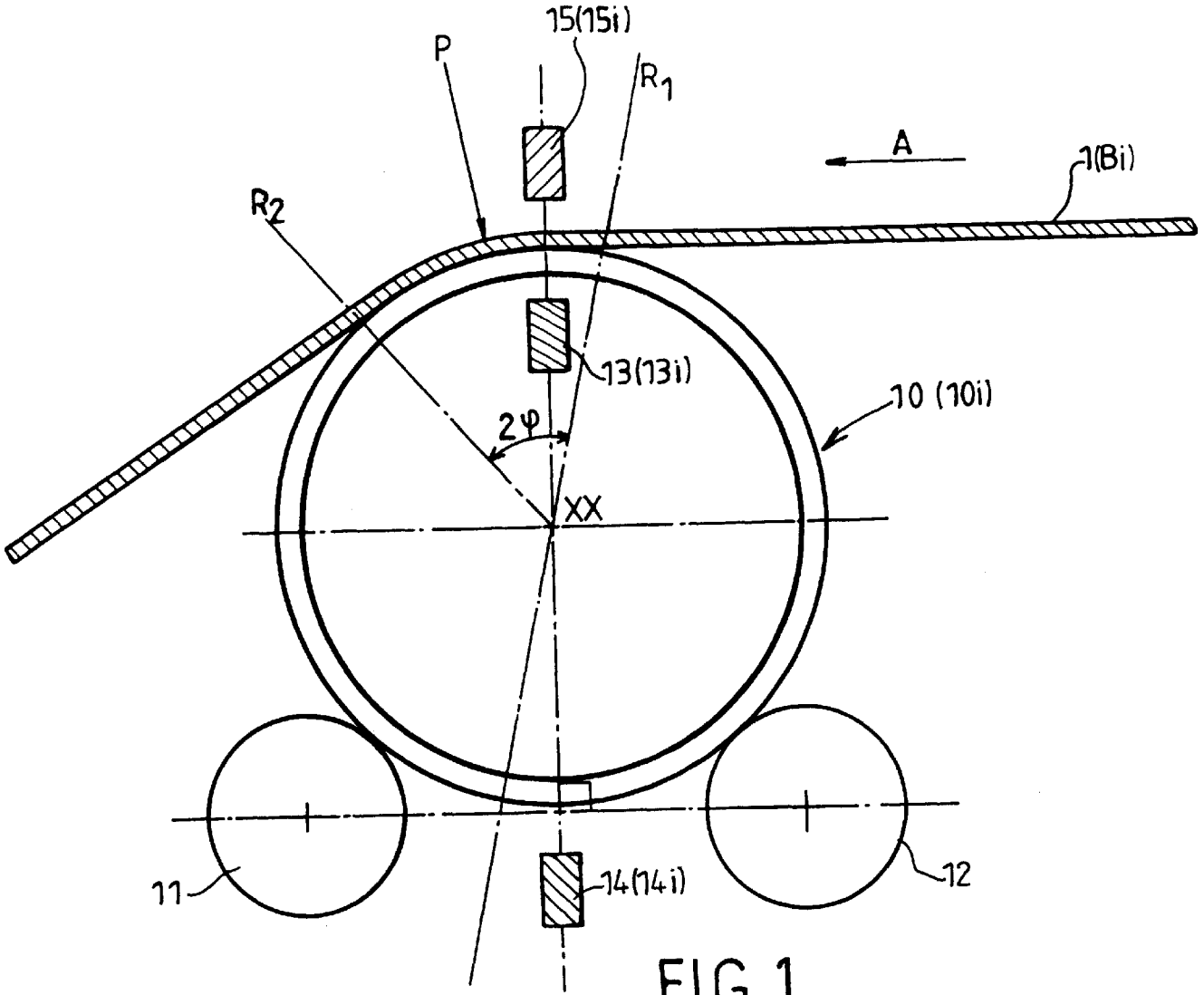

The sensors (13, 13*i*) are fixed to and associated with the deformable peripheral regions of the roller in order to detect the deformation thereof under the effect of the strip and to provide signals in dependence on the deformation.

A utilization circuit receives the signals of the sensors in order to derive data and control signals therefrom.

20 Claims, 4 Drawing Sheets

APPARATUS FOR MEASURING THE FLATNESS OF A STRIP IN MOVEMENT

The present invention relates to apparatus for measuring the flatness of a strip in movement, particularly of a metal strip in a production line, comprising:

a means for putting the strip under tension in order to apply a longitudinal tension thereto and to pull the strip onto a winding roller.

a measuring roller around which the strip is wound, this roller being equipped with sensors providing signals for determining the local internal tension of the strip.

The flatness of a strip or of a plate, within the meaning of the present invention, is the degree of equilibrium of the internal stresses of the strip or of the plate. In other words, the greater the imbalance of the internal stresses of a product is, the less flat the product will be and vice versa.

In many fields and, in particular, in the manufacture of metal products intended especially for electronics or similar applications, parts for electrical or electronic equipment, connectors, supports for cable components, or water heaters, a metal strip is manufactured by rolling and straightening operations, etc. This strip is then split into smaller strips from which the parts are made.

The rolling performed before these various operations by a surface pressure exerted by rolls reduces the thickness of the strip and makes it proportionally longer.

In practice, owing to bending or expansion of the rolls, the reduction in thickness of the strip is not strictly uniform either in the direction of the width or in the direction of the length. This is translated into local internal compression and tensile stresses. These stresses may have no apparent effect on the strip produced if they remain small enough to avoid local buckling ("blisters", "crinkling") of the sheet metal.

However, when this strip is split into smaller strips serving for the manufacture of the above-mentioned products, this equilibrium is broken and the smaller strips are deformed in a disorderly manner under the effect of the internal stresses.

The specifications, particularly the geometrical specifications, set for the products to be cut out are becoming ever stricter. In order to conform to the deflection tolerances, to facilitate the shearing operation, and to prevent burrs after the shearing of the strip, the strip must be free of any internal tension at the input to the splitter.

Installations or apparatus exist for detecting such faults in the strip by measurement of the local internal stresses. However, this known apparatus is extremely complex and expensive.

It is in fact composed of a rigid rotary measuring roller onto which the strip the flatness of which is to be measured or determined is wound. This roller is equipped with pressure sensors incorporated in its outer surface. These pressure sensors, which are fixed to the measuring roller, rotate therewith. It is therefore necessary to transmit the signals by sliding contacts, which is a difficult technical problem requiring very complicated means given the low level of the signals provided by the pressure sensors.

The object of the present invention is to remedy these problems and to create simple, robust apparatus which can provide accurate results, particularly discrete measurements spatially associated with the different portions of the strip with very fine resolution, in order to bring about correction operations upstream, and an installation with a low maintenance cost.

For this purpose, the invention relates to apparatus of the type defined above, characterized in that:

the measuring roller comprises independent peripheral regions deformable by compression, the sensors are fixed to an associated with the deformable peripheral regions of the roller in order to detect the deformation thereof under the effect of the strip and to provide signals in dependence on the deformation.

a utilization circuit receiving the signals of the sensors in order to derive data and control signals therefrom.

According to a further particularly advantageous characteristic:

each deformable peripheral region of the measuring roller is formed by a ring, the rings being juxtaposed, independent of one another, and bearing on two reference cylinders, at least one sensor is associated with each ring in order to detect the deformation thereof under the effect of the strip.

the rings are advantageously fixed for rotation with one another.

The mounting of two facing sensors per ring, measuring the diametral flattening (and not merely the radial flattening) of the corresponding ring, greatly simplifies the numerical analysis of the measurements and increases their accuracy by freeing them from any additional correction for the yielding of the support rollers ("reference cylinders") which is variable a priori in dependence on the winding pressure.

According to another advantageous characteristic, the rings are identical.

The apparatus according to the invention is of quite simple construction, particularly in the case of a measuring roller formed by juxtaposed rings. It is easily incorporated in a production line for metallurgical processing at the output of rolling mills or straightening machines. The detection of the parameters connected with the flatness, that is, the deformation of the measuring roller (or of the rings of which the measuring roller is composed) is performed by distance sensors which are fixed. This eliminates any difficulties in the transmission of the signals.

The width of the deformable peripheral regions or of the rings of which the measuring roller is composed is selected in dependence on the desired fineness of resolution.

The strip is thus theoretically broken down into smaller strips each applied to a ring of the measuring roller. If this smaller strip has a large tensile stress, this is translated into a compression force acting on and flattening the ring. The flattening is detected by the sensor which thus supplies a signal depending on the internal stress prevailing at the locations corresponding to this smaller strip.

Continuous monitoring of the profile of internal stresses in the strip measured by the flatness-measuring roller at the output of the finishing mill or of the straightening machine permits optimal regulation of all of the operating gear of these machines; the camber and bracing of the rolling rolls, the swing and curvature of the straightening cassettes.

The highly accurate production of the rings corresponds to a set of normal machining operations in order for the two faces of each ring to be perfectly perpendicular to their axis of rotation.

The same care and the same accuracy must be applied to the production of the support rollers which must be not only well balanced but also perfectly parallel.

Finally, the precision of the production of the rings and, in particular, the flatness of their faces and the perpendicularity of these faces to their axis, reduces friction between the rings to a minimum, that is to say, a contrario, that each of the rings can be deformed on the support rollers independently of the others.

Figure 3:
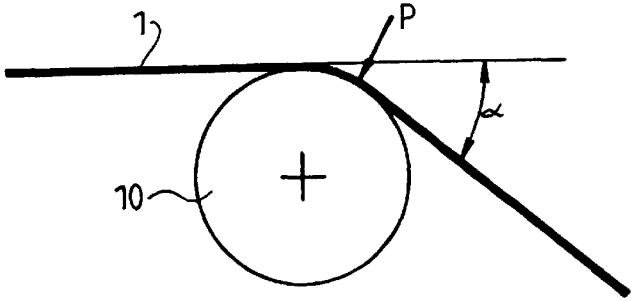
Figure 4:
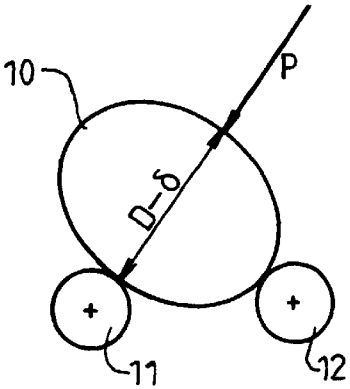
Figure 2:
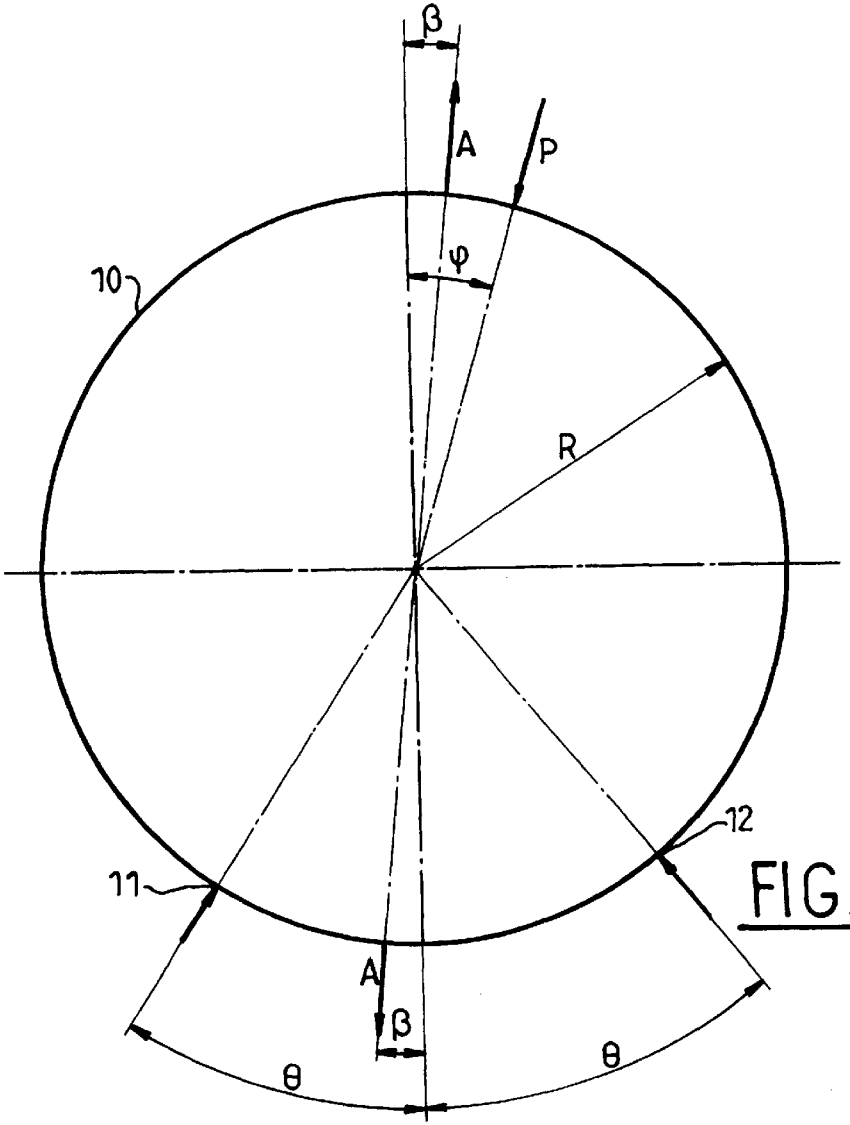
Figure 6:
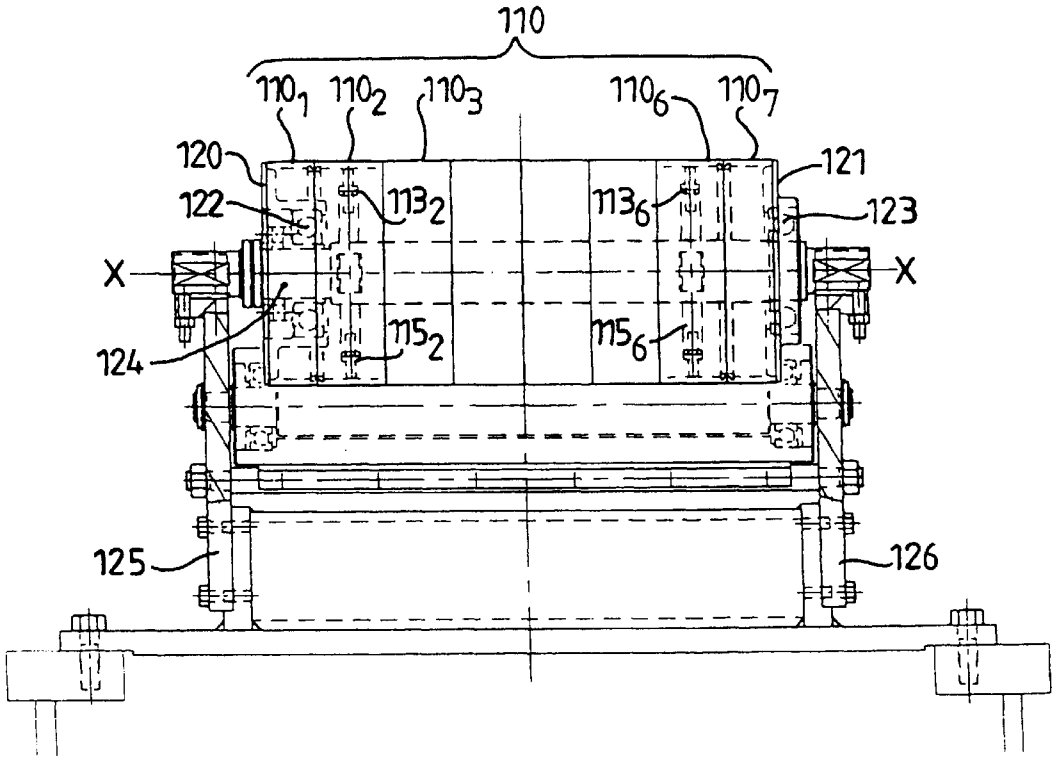
Figure 5:
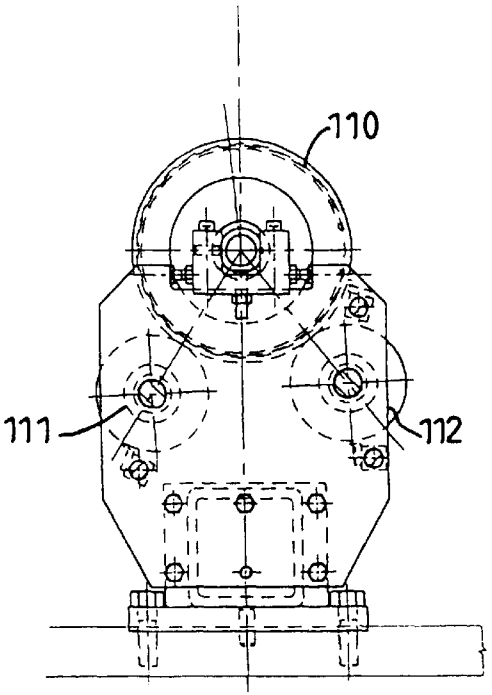
Figure 8:
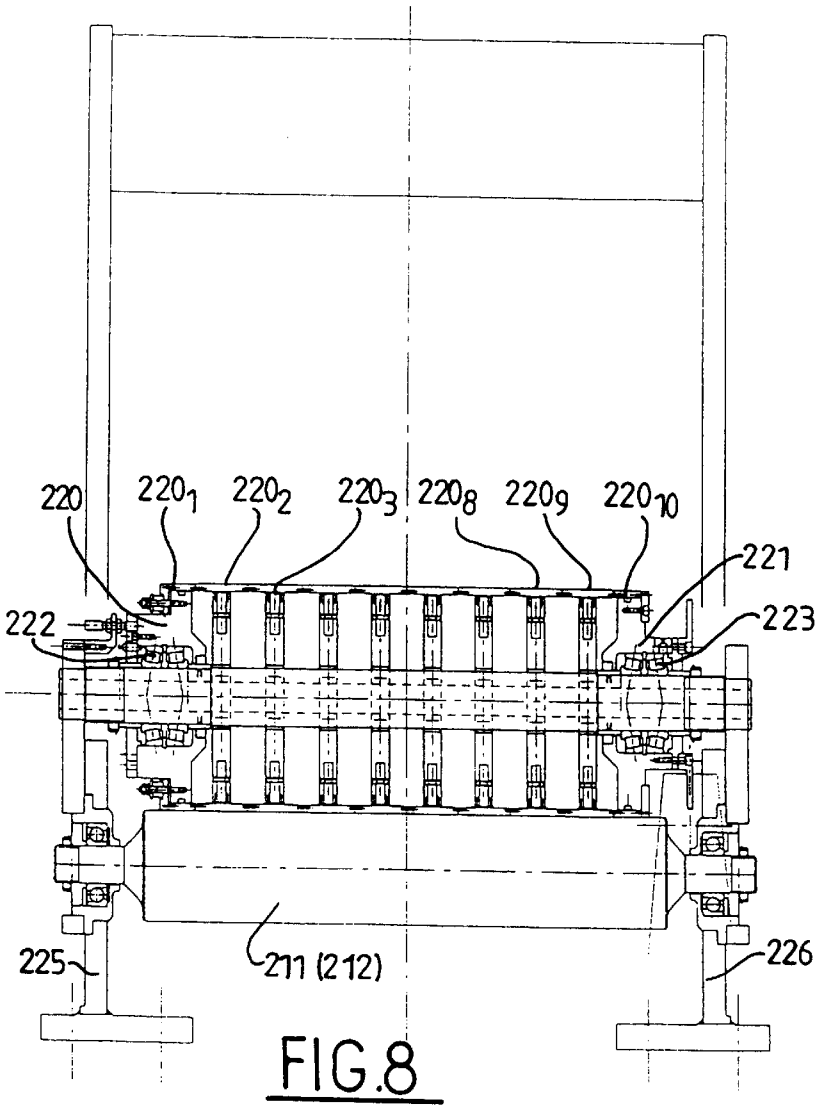
Figure 7:
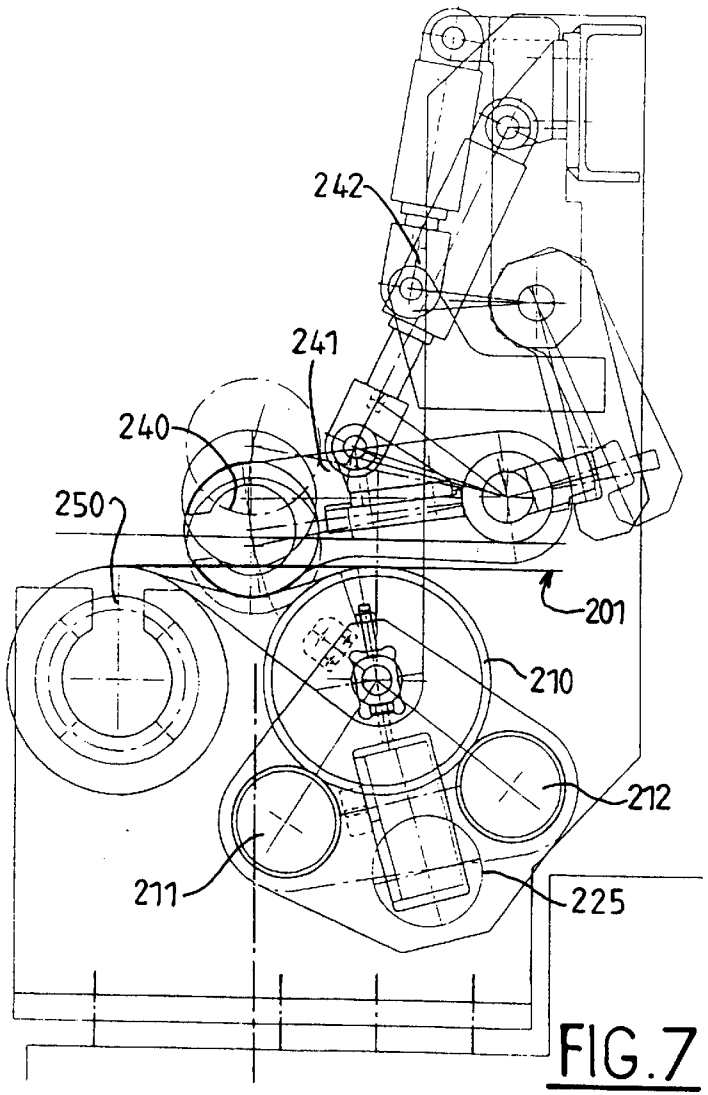

The present invention will be described in greater detail below with the aid of various embodiments shown schematically in the appended drawings, in which:

FIG. 1 is a very schematic, sectioned view of apparatus for measuring the flatness of a strip according to the invention, FIG. 2 is a dynamics diagram showing the various angular parameters and the points of action of the forces exerted on a ring, FIG. 3 is a general diagram, FIG. 4 is a complementary diagram, FIG. 5 is a side view of a first embodiment of a flatness measuring machine according to the invention, FIG. 6 is a front view of the machine of FIG. 5, FIG. 7 is a side view of another embodiment of a flatness measuring machine according to the invention, FIG. 8 is a simplified front view corresponding to FIG. 7.

According to FIG. 1, the invention relates to apparatus for measuring the flatness of a strip 1 in movement, that is, travelling in the direction of the arrow A. Although, in principle, this may be any strip, the invention relates particularly to metal strips and especially to non-ferrous metal strips output from production, in order to check the characteristics and correct the operation of the installation upstream. This apparatus is composed of a measuring roller 10 deformable by peripheral regions. It is advantageously formed by a set of identical juxtaposed rings which are free of one another but rotate at the same speed so that a mean taken of the measurements achieves a good correction of the production faults of each ring.

The rings are free of one another in that they can slide freely against one another in order to be flattened freely. These rings have an axis XX perpendicular to the plane of FIG. 1.

By way of example, not shown, the rings may have pins on one of their edges and recesses in homologous positions and of dimensions larger than those of the pins on their opposite edge. The rings thus formed are connected by these pin/recess connections, leaving sufficient play for the rings to be freely deformable relative to one another.

The deformable measuring roller thus formed of rings which are deformable (within very small but nevertheless adequate limits) enables the internal stresses of the strip to be detected as will be explained with the aid of FIGS. 2, 3, 4. For simplification, since this set of rings is equivalent to the above-described roller, it will bear the same reference numeral.

The set of rings 10 is carried by two support cylinders 11, 12. The strip 1 to be monitored bears on the set of rings 10 with a winding angle 2ϕ included schematically between the two radii R1, R2.

The flattening force P exerted by the strip 1 on the rings 10 or, more precisely, the force exerted by the various theoretical elemental small strips Bi of the strip 1 which bear on the various rings 10, brings about a flattening of each ring 10*i* substantially along the bisector of the winding angle.

This flattening is measured by a series of sensors 13 (13*i*) preferably placed inside the set of rings 10. These sensors 13*i* are mounted in a fixed manner since the interior of the rings 10 is clear and accessible. Each of these sensors 13*i* supplies a signal relating to the deformation of the ring 10*i* with which it is associated. Neither the lines for the transmission of the signals, nor the utilization circuit utilizing these signals in order to control the installation in which the apparatus is incorporated are shown.

The installation may also be completed by a series of sensors 14*i* aligned diametrally with the sensors 13*i* but situated outside and beneath the set of rings 10*i*. The inner sensors 13*i* may also be replaced by these outer sensors 14*i* which may be easier to fit and maintain.

Finally, the apparatus may include a set of outer sensors 15*i* situated above the winding region to permit a profile measurement of the profile transverse the strip in parallel with the flatness measurement.

All of the rings of the set 10, of which only one is visible, have the same geometry; they are produced with very great precision and their outer surfaces are preferably polished and are very hard to avoid any scratching which, in time, would damage the surface condition of the strip passing over the ring.

These rings are preferably made of structural steel or tool steel.

According to the installations, the measuring apparatus may be placed directly at the output of a rolling-mill table or of a straightening machine. In this case, the set of rings 10 constitutes the winding roller. The winding pressure depends greatly on the winding angle and on the tension applied to the strip.

The roller 10 of the flatness-measuring apparatus may also serve as a support for the strip which is subject to a pressure roller which keeps the pressure almost constant regardless of the tension on the strip on the measuring roller, as will be seen in the second embodiment.

The sensors 13 (13*i*), 14 (14*i*), 15 (15*i*) are preferably contactless, inductive, proximity sensors which are very easy to fit and, moreover, are not in contact with or subject to wear by the rings. These sensors are very compact and the cost of using them is low; the accuracy of the measurements which they make is very satisfactory. They provide analogue output signals. These signals can be used as they are or may be converted into digital signals.

The principal of the measurements will be explained below with the aid of the diagram of FIG. 2 which shows a roller 10 of radius R bearing on two point supports 11, 12 representing the points of support of the roller 10 on the cylinders 11, 12. A force P (resulting from the internal stresses of the strip) is applied to this roller. The measurement is taken along the axis AA which is offset by an angle β relative to the bisector of the angle 2θ formed by the radii passing through the two supports 11, 12. The winding angle is equal to 2ϕ.

The diametral flattening δ measured along the measurement axis AA is given by the following formula, in which E represents the modulus of elasticity of the roller.

An analytical calculation of the pure bending deflection without taking account either of the tension or of the shear stress of the roller gives the following linear equation between the winding pressure and the diametral flattening (in this case the winding angle is equal to 2ϕ):

$$\delta = \frac{R^3 \times F}{E \times I} \times \left\{ \begin{array}{l} -\frac{\pi}{4} \times \cos(\varphi - \beta) - \frac{\sin(\theta + \varphi)}{2 \times \sin(2 \times \theta)} \times [\sin(\theta - \beta) - (\theta - \beta) \times \cos(\theta - \beta) - \\ \theta \times \sin(\theta - \varphi) \times \sin(\varphi - \beta)] + \frac{1}{\pi} + \frac{\cos(\varphi)}{\pi \times \cos(\theta)} \end{array} \right\}$$

in which $$I = \tfrac{1}{12} \times (\text{thickness}^2 \times \text{width})$$

The method of measuring flatness as described above is intended in particular for measuring the flatness of strips of metals, particularly of non-ferrous metals such as copper or copper- alloy strips used for manufacturing in the electrical and electronics fields. In this case, the process and the apparatus which uses it receive a strip which is moving and the measurements are taken throughout the movement of the strip. These measurements are generally taken discontinuously.

According to FIGS. 3 and 4, the strip 1 extends around a measuring roller 10 with a winding angle α. As a result, the strip 1 exerts a pressure P on the measuring roller 10 causing diametral deformation by flattening thereof. The diameter D of the roller is thus reduced by δ, which is measured by sensors.

If the strip 1 is broken up into smaller strips, and if a smaller strip under consideration has a tensile stress Si, the compression force Γ which it exerts on the roller 10 for the winding angle α is given by the following formula:

$$Pi\text{–}2\ e\ 1\ .\ S_1 \cdot \mathrm{Sin}\ \alpha/2.$$

This compression causes a flattening δi of the roller and this flattening is proportional to the compression force δi=K=Pi. The constant K depends solely on the geometry and the physical characteristics of the roller and of its support.

According to the technology of the sensors, either a zero re-setting procedure or an automatic re-calibration of the measuring roller is used. These operations are all the simpler if the acquisition and processing of the measurements are digital. In order to calibrate each ring, it suffices to press a roller onto the rings, ideally with various loads, and to measure the corresponding flattenings.

Finally, in order automatically to correct any out-of-round defect between the internal bore and the external alignment of the rings, a measurement of diametral flattening (the sum of the 2 opposed radial displacements) is performed in preference to a simple radial measurement under the contact of the ring with the strip. Since the internal stresses do not fluctuate significantly over lengths of less than a meter, the arithmetic mean of two (radial) flattening measurements taken for each half-turn corrects a "out-of-round" defect in the same way, without bias. The arithmetic mean of two (diametral) flattening measurements taken every half-turn also corrects any periodic "ovalization" defect. The arithmetic mean of 3 (or 4) (diametral) flatness measurements taken every third of a turn corrects any "trilobal" (or four-leafed clover-type) periodic defect, respectively. Any combination of these four types of defect will in fact be corrected without bias if the flattening measurement considered is the arithmetic mean of 12 diametral flattening measurements. An optimum could be fixed at 24 measurements per turn. This analysis (or any basically comparable analysis based, for example, on a simple procedure based on rapid Fourier inversion) enables the specifications for the machining of the rings of the measuring roller to be lightened very significantly. On the other hand, it requires the rings to be fixed to one another for rotation. Ideally, a pulse is generated periodically, for example, every twelfth of a turn, by the rotation of the measuring cylinder itself, and triggers the acquisition of the flattening measurements of all of the rings at that moment.

By way of numerical example, the rings generally have a diameter of a few hundred millimeters, and a thickness of the order of about ten millimeters. The flattenings to be measured are of the order of one tenth of a millimeter. The fluctuations due to variations in residual stresses are of the order of one hundredth of a millimeter.

According to FIGS. 5 and 6, a first embodiment of apparatus according to the invention is composed of a measuring roller 110 composed of independent rings $\mathbf{110}_1 \ldots \mathbf{110}_3 \ldots \mathbf{110}_7$ positioned on the geometric axis XX. The rings are supported laterally by plates 120, 121 mounted so as to be freely rotatable by means of ball bearings 122, 123 carried by a fixed shaft 124 equipped with sensors $\mathbf{113}_2$, $\mathbf{115}_2$ associated with the ring $\mathbf{110}_2$, sensors $\mathbf{113}_6$, $\mathbf{115}_6$ associated with the ring $\mathbf{110}_6$, etc. The outer rings $\mathbf{110}_1$ and $\mathbf{100}_7$ complete the measuring roller 110 at the level of the bearings 120, 121 to facilitate the retention of the intermediate rings and their rotation. No sensor is associated with these end rings $\mathbf{110}_1$, $\mathbf{110}_7$ which may, if necessary, receive the edge of the strip to be monitored (not shown).

The roller 110 rests on two cylinders 111, 112 mounted in plates 125, 126 of the frame of the machine.

The various accessories and, in particular, the electrical connections and the wiring connecting the sensors to the electronic utilization circuit are not shown.

The wiring of the sensors $\mathbf{113}_2 \ldots \mathbf{113}_6$, $\mathbf{115}_2 \ldots \mathbf{115}_6$ presents no difficulty since only the rings rotate and not the sensors.

FIGS. 7 and 8 shown another variant of the apparatus for measuring flatness according to the invention.

This apparatus is composed, as in the previous embodiment, by a measuring roller 220, in this case formed by ten freely rotatable rings $\mathbf{220}_1 \ldots \mathbf{220}_{10}$ bearing on two support cylinders 211, 212 mounted in plates 225, 226 of the machine.

The outer rings $\mathbf{220}_1$–$\mathbf{220}_{10}$ are mounted on end elements 220, 231 carried by rolling bearings 222, 223.

The strip 201 to be monitored moves and is wound onto the roller 220 whilst being strained by a pressure roller 240 carried by an arm 241 and subject to a jack 242. This pivoting system which exerts a constant force on the strip 201, is shown in two different positions in FIG. 7.

At the output, the strip passes over an output cylinder 250.

What is claimed is:

1. Apparatus for measuring the flatness of a strip in movement, particularly of a metal strip in a production line, comprising:

a means for putting the strip under tension in order to apply a longitudinal tension thereto;

a measuring roller comprising independent peripheral regions deformable by compression, around which roller the strip is wound;

sensors associated with said deformable independent peripheral regions of said roller in order to detect the deformation thereof under the effect of the strip and to provide signals in dependence on the deformation; and a utilization circuit receiving said signals from said sensors in order to derive data and control signals therefrom.

2. Apparatus according to claim 1, wherein each of said deformable individual peripheral regions of the measuring roller is formed by a ring, the rings are juxtaposed, are independent of one another, and bear on two reference cylinders, and at least one said sensor is associated with each said ring in order to detect the deformation thereof under the effect of the strip.

3. Apparatus according to claim 2, wherein said rings are fixed for rotation with one another.

4. Apparatus according to claim 2, wherein said rings are identical.

5. Apparatus according to claim 2, wherein said rings are metallic.

6. Apparatus according to claim 2, wherein one of said sensors is associated with and disposed in each of said rings.

7. Apparatus according to claim 1, wherein one of said sensors is associated with and disposed outside each of said independent peripheral regions.

8. Apparatus according to claim 7, further comprising further external sensors, one of said further external sensors being associated with each of said independent peripheral regions for permitting characterization of the transverse profile of the strip complementary to said sensors for detecting said deformation of said independent peripheral regions.

9. Apparatus for measuring the flatness of a strip in movement, particularly of a metal strip in a production line, comprising:

a means for putting the strip under tension in order to apply a longitudinal tension thereto;

two reference rollers;

a measuring roller comprising a plurality of juxtaposed independent rings deformable by compression, around which roller the strip is wound, said rings bearing on said two reference rollers;

a plurality of sensors, at least one of said sensors being associated with each of said rings, to detect the deformation of the respective said ring under the effect of the strip and to provide signals in dependence on the deformation; and a utilization circuit receiving said signals from said sensors in order to derive data and control signals therefrom.

10. Apparatus according to claim 9, wherein said rings are fixed for rotation with one another.

11. Apparatus according to claim 9, wherein said rings are identical.

12. Apparatus according to claim 9, wherein said rings are metallic.

13. Apparatus according to claim 9, wherein said at least one sensor associated with each of said rings is disposed inside its associated ring.

14. Apparatus for measuring the flatness of a strip in movement under longitudinal tension, particularly of a metal strip in a production line, comprising:

a measuring roller comprising a plurality of independent peripheral regions deformable by compression, around which roller the strip is deflected;

a plurality of sensors associated with said deformable independent peripheral regions of said roller to detect the deformation of said independent peripheral regions under the effect of the strip and to provide signals in dependence on the deformation; and a utilization circuit receiving said signals from said sensors in order to derive data and control signals therefrom.

15. Apparatus according to claim 14, further comprising two reference cylinders, wherein said measuring roller further comprises a plurality of rings, wherein each of said plurality of deformable individual peripheral regions of the measuring roller is formed by a respective ring of said plurality of rings, wherein said rings of said plurality of rings are juxtaposed, are independent of one another, and bear on two reference cylinders, and wherein at least one of said plurality of sensors is associated with each said ring of said plurality of rings in order to detect the deformation thereof under the effect of the strip.

16. Apparatus according to claim 15, wherein said ring of said plurality of rings are fixed for rotation with one another.

17. Apparatus according to claim 15, wherein said rings of said plurality of rings are identical.

18. Apparatus according to claim 15, wherein one of said plurality of sensors is disposed within each ring of said plurality of rings.

19. Apparatus according to claim 14, wherein one of said plurality of sensors is associated with each independent peripheral region of said plurality of independent peripheral regions, and is disposed outside its associated independent peripheral region.

20. Apparatus according to claim 14, further comprising further external sensors, one of said further external sensors being associated with each of said plurality of independent peripheral regions for permitting characterization of the transverse profile of the strip complementary to said sensors for detecting said deformation of said independent peripheral regions.

* * * * *